US006946057B2

(12) United States Patent
Stigsson

(10) Patent No.: US 6,946,057 B2
(45) Date of Patent: Sep. 20, 2005

(54) ALKALINE PROCESS FOR THE MANUFACTURING OF PULP USING ALKALI METABORATE AS BUFFERING ALKALI

(75) Inventor: Lars Stigsson, Saltsjobaden (SE)

(73) Assignee: Kiram AB, Saltsjobaden (SE)

( * ) Notice: Subject to any disclaimer, the term of this patent is extended or adjusted under 35 U.S.C. 154(b) by 193 days.

(21) Appl. No.: 10/660,660

(22) Filed: Sep. 12, 2003

(65) Prior Publication Data

US 2005/0098280 A1 May 12, 2005

(30) Foreign Application Priority Data

Sep. 12, 2002 (SE) ..... 0202711

(51) Int. Cl.[7] ..... D21C 1/02; D21C 3/02; D21C 11/04

(52) U.S. Cl. ..... 162/80; 162/30.1; 162/37; 162/65; 162/90

(58) Field of Search ..... 162/30.1, 37, 65, 162/80, 90

(56) References Cited

U.S. PATENT DOCUMENTS

| | | | | |
|---|---|---|---|---|
| 2,146,093 A | | 2/1939 | Ritchie et al. | |
| 3,068,141 A | * | 12/1962 | MacClaren et al. | 162/80 |
| 3,594,270 A | * | 7/1971 | Schattner et al. | 162/80 |
| 4,116,759 A | * | 9/1978 | Janson | 162/32 |
| 4,248,662 A | | 2/1981 | Wallick | |
| 6,294,048 B1 | | 9/2001 | Bair et al. | |
| 6,348,128 B1 | | 2/2002 | Tran et al. | |
| 6,663,749 B2 | * | 12/2003 | Bair et al. | 162/29 |
| 6,770,168 B1 | * | 8/2004 | Stigsson | 162/24 |

FOREIGN PATENT DOCUMENTS

WO WO 00/47812 8/2000

OTHER PUBLICATIONS

Jan Janson., Paperi ja Puu– Papper och Tra, No. 8, 1979, p. 495–504 Autocausticizing Alkali and its use in Pulping and Bleaching.

"The Effect of Borates on Kraft. Kraft–AQ and Soda–AQ Cooking of Black Spruce,", S. Prihoda et al., Paperi ja Puu–Paper and Timber Vo. 78 No. 8, 1996, p. 456–460.

* cited by examiner

*Primary Examiner*—Steven P. Griffin
*Assistant Examiner*—Anna L. Kinney
(74) *Attorney, Agent, or Firm*—Young & Thompson

(57) ABSTRACT

The present invention relates to a new and environmentally sound process for the manufacturing of a chemical pulp from lignocellulosic material with an integrated recovery system for recovery of pulping chemicals. The process is carried out in several stages involving a pre-treatment stage followed by one or more delignification stages using an alkaline buffer solution comprising alkali metaborate and sodium carbonate as major components. The alkaline components of the pulping liquor are recovered from a chemicals recovery furnace and at least a portion of the alkali is recycled and used for delignification without any prior reactions with lime or calcium compounds for generation of alkali hydroxide. A quinone based delignification catalyst may be added to be present during delignification.

14 Claims, 2 Drawing Sheets

ALKALINE PROCESS FOR THE MANUFACTURING OF PULP USING ALKALI METABORATE AS BUFFERING ALKALI

The present invention relates to a process for the manufacturing of chemical and semi-chemical pulp from lignocellulosic material.

BACKGROUND TO THE INVENTION

In the last decades, under the driving forces of energy, environmental and economic constraints, large efforts have been made with the aim of finding new technologies to replace the well-established Kraft process for the manufacturing of chemical pulp. The traditional Kraft process accounts for most of the chemical pulp production in the world and commands several advantages over alternative processes such advantages including insensitivity to wood quality and superior physical pulp properties.

The Kraft process however has some well-known drawbacks such as a low pulping yield, generation of odorous reduced sulphur compounds and capital investments particularly for the chemicals recovery system.

Soda anthraquinone (soda AQ) pulping is a well-known process alternative to the Kraft process, which offers some simplification of the chemicals recovery process, as there is no requirement for a reducing zone in the recovery furnace. Furthermore the odorous and toxic sulphurous emissions are substantially eliminated by the elimination of sulphide as an active pulping chemical. On the other hand, the replacement of sulphide demands a higher charge of sodium hydroxide to the soda AQ cook in order to compensate for the lost effective alkali from hydrolysis of sodium sulphide in the Kraft chemicals recovery cycle. Consequently, the lime reburning and causticizing plant in the soda AQ mill, for a given effective alkali charge to the cook, have to be from 20 to 50% larger than in a Kraft mill with a corresponding pulping capacity. Therefore, on balance, and also considering the weaker pulps of traditional soda AQ pulps in comparison to Kraft pulps, soda AQ pulping has not met with commercial success and only a few mills in the world are practising the process.

Alkaline puping processes such as the Kraft, soda AQ and alkaline sulphite processes use strong alkali, sodium hydroxide, to provide for the alkalinity of the cook. In the Kraft process a chemical reagent referred to as "white liquor" is used for delignification and added to the digester. Typically, the white liquor is an alkaline aqueous solution of sodium hydroxide (NaOH) and sodium sulfide ($Na_2S$) containing between about 90–100 grams/litre of NaOH and about 20–40 grams/litre $Na_2S$ with minor quantities of inert chemicals such as sodium carbonate, sulphate and thiosulphate. Depending upon the wood species used and the desired end product, white liquor is added to the wood chips in sufficient quantity to provide a total charge of alkali of 15–22% NaOH based on the dried weight of the wood.

Typically, the temperature of the wood/liquor mixture in the digester is maintained at about 145° C. to 170° C. for a total reaction time of about 2–3 hours. When digestion is complete the resulting Kraft wood pulp is separated from the spent liquor (black liquor) comprising used chemicals and dissolved lignin.

Conventionally, the black liquor is burnt in a Kraft recovery race to form a smelt comprising sodium and sulphur chemicals. The smelt is dissolved in an aqueous solution, usually in weak wash, to form green liquor, containing $Na_2CO_3$ and $Na_2S$, which is mixed with lime (CaO) to form a turbid mixture containing particles of slaked lime ($Ca(OH_2)$). The mixture is recausticized according to the scheme.

$$Ca(OH)_2+Na_2CO_3=2NaOH+CaCO_3$$

The alkalinity of the liquor is thereby restored and fresh Kraft white liquor is obtained for use in the digestion process. The sodium sulphide is not participating in the recausticizing process, although sodium sulphide is contributing significantly to the alkalinity of the white liquor. A number of discrete causticizer vessels are normally used to reduce the risk of lime particles migrating directly out of the system without undergoing reaction. Usually, the reacted mixture is passed to a clarifier which separates it into a liquid phase which is strong in NaOH and which is used in the pulping process, and a phase heavy in solids (mainly $CaCO_3$) which is washed with water to reduce its white liquor content, and then passed to a lime kiln where the solids are calcined to yield fresh CaO. Because of the inefficiency of the conventional recausticizing process, a dead load of unreacted $Na_2CO_3$, considered as an inert in alkaline cooks such as Kraft and soda AQ, is carried in the white liquor to the pulping process and hence through the Kraft liquor cycle. The white liquor content of strong alkali, all of NaOH and one half of the $Na_2S$ content is called effective alkali.

In soda AQ pulp mills the recaustcizing and lime reburning operation is essentially the same as in the Kraft process except that, for a given charge of effective alkali, even larger equipment capacities are needed for the regeneration of strong alkali as there is no contribution of effective alkali from sodium sulphide hydrolysis.

The caustic and lime reburning operation in pulp mills represent a high investment and operating cost and frequently these units are bottlenecks in mill expansion projects.

Over time there has been a considerable interest in finding says to eliminate the lime reburning and causticizing operation in alkaline processes through so called autocausticizing. The proposed autocausticizing processes are normally based on the use of amphoteric salts to release carbon dioxide directly from sodium carbonate in the Kraft recovery furnace. Strong alkali (NaOH) is then generated directly from the smelt in a dissolving tank. The most promising autocausticizing agents are based on boron. Boron based autocausticizing could potentially supply either part or all of the hydroxide requirements in the Kraft pulping process. Janson initiated the use of bores for autocausticising it the pulp and paper industry in 1976 and a US patent was granted to Janson in 1977, U.S. Pat. No. 4,116,759. A full-scale mill trial on Janson's autocausticizing concept was performed at the Enzo Gutzeit linerboard Kraft mill in Kotka, Finland in 1982. The results were inconclusive and the mill discontinued the use of borates for autocausticization. Due to the high load of boron compounds in the pulping liquor, in accordance with the stoichiometry proposed by Janson, the ionic strength of the borate liquor was much higher than the corresponding Kraft pulping liquor. Increased ionic strength of the cooking liquor is commonly said to have a negative impact on the rate of delignification. Furthermore, the large boron charges significantly increased the inorganic load in the recovery cycle.

In their research, Janson and co-workers concluded that the presence of sulphide in the recovery boiler smelts counteracts the autocausticizing reactions of borates, which would be an obvious drawback in Kraft applications. Moreover, for sulphide containing smelts, the presence of carbon dioxide exacerbated the negative effect of sulphide. (Janson J., Autocausticizing alkali and its use in pulping and bleaching, in *Paperi ia Puu—Papper och Trä*, No 8, 1979, 495–504.) In the binary smelt system $Na_2S—B_2O_3$), glass formation has been found to occur and compounds of the structure $Na_2S—nB_2O_3$ (n=2–4) are formed. Thus any sulphide present in the recovery boiler smelt would bind to borates, which else would be available for autocausticizing reactions. Indeed more recent mill scale borate autocausticizing trials in Kraft mills have indicated lower an expected autocausticizing efficiency, which may, at least partly, be due to the presence of sulphide.

Janson concluded hat, of the different borates, sodium metaborate ($NaBO_2$) was too weakly alkaline to be considered for pulping, but quite possible to use in e.g. oxygen bleaching applications. (Janson, J., *Paperi ja Puu* supra). In his '759 patent Janson teaches, if the borate in its causticized form is sufficiently alkaline which is the case for secondary sodium borate $Na_2HBO_3$, it is useable as delignification chemical. Oxygen bleaching experiments are presented in '759 as examples of the use of the weaker alkali $NaH_2BO_3$. Janson as well as other researchers in more recent borate pulping studies indeed treat the sodium metaborate as an inert substance during pulping and after the strong hydroxide is consumed in the borate liquor cooks the boron is present as metaborate in the spent pulping liquor.

Of the borates studied by Janson the strongly alkaline tetra sodium diborate ($Na_4B_2O_5$), or ($Na_2HBO_3$) in aqueous solutions, were selected as the source of alkali and this latter substance was used in pulping experiments. The tetra sodium diborate stoichiometry of Janson suggests the presence of one mole of boron compound (as boron) for every mole of regenerated hydroxide in the pulping liquor. After the digestion process, the borate containing spent pulping liquor comprises dissolved light and bore corresponding to the composition of ($NaBO_2$), sodium metaborate. The spent liquor is burned in a recovery furnace and the tetra sodium borate is formed to complete the autocausticizing cycle of Janson.

Janson also briefly discussed the use of anthraquinone in combination with hydroxide or disodium borate ($Na_2HBO_3$) as alkali source. It was, however, concluded that the hydroxide based cooks proceeded considerably faster, especially in the early phase, than the borate based cooks. (Janson, J., *Paperi ja Puu*, supra).

Further work in the area of autocausticizing were performed by Wandelt and co-workers during the 1990s trying to establish whether borate based autocausticizing pulping liquors were as good as sodium hydroxide based cooking liquors in terms of delignification rate, selectivity of delignification, and the quality of the final pulp. The gravity of work by Wandelt and co-workers were on Kraft applications, in other words for pulping systems comprising sulphide, but data were also reported for soda AQ borate alkali pulping experiments. Disodium borate ($Na_2HBO_3$) was used as borate alkali. They concluded that "a very slow delignification rate was obtained for sulphur-free soda AQ borate cooking, where instead of 19.5% NaOH (originating from hydrolysis of the $Na_2HBO_3$) on wood, 26.7% NaOH had to be used to achieve kappa number 60 during 90 minutes of digestion at 170° C., and it was practically impossible to get bleachable grade pulp of kappa No. 30. Such a process cannot compete with conventional pulping" (Prihoda S., Wandelt P., Kubes G. J., The effect of borates on Kraft, Kraft AQ and soda-AQ cooking of black spruce, in *Paperi ja Puu—Paper and Timber*, Vol 78, No 8, 1996 p 456–460.)

In these prior art borate pulping studies the sodium to boron molar ratio in circulating liquors was kept well below 2 and indeed, Janson in U.S. Pat. No. 4,116,759 teaches that it is essential to keep the sodium to boron molar ratio equal to or less than 2 in order to ensure desired autocausticization. Sodium carbonate ($Na_2CO_3$), commonly considered as being an inert component in a Kraft pulping liquor will be present in typical recovery boiler smelts and, if autocausticization is not 100% efficient, this compound will also be present in the pulping liquor. Sodium carbonate however was not added to any of the borate pulping liquors used in the above referenced pulping studies.

There are recent indications that a key borate compound formed in a recovery furnace would be trisodiumborate ($Na_3BO_3$), rather than the tetrasodium borate ($Na_4B_2O_5$) as suggested by Janson. This has sparked a new wave of interest in borate-based autocausticizing. Trisodium metaborate will form strong alkali and sodium metaborate upon dissolution in water. The overall stoichiometry suggests that only half a mole of borate is needed to regenerate one mole of hydroxide in the liquor system. Two patents have recently been issued in USA using borates for partial autocaustizing combined with traditional lime causticizing, U.S. Pat. No. 6,294,048 and U.S. Pat. No. 6,348,128. Both these patent are based on the use of lime and conventional causticizing to prepare strongly alkaline pulping liquor.

The phase equilibrium diagram of the binary system $Na_2O—B_2O_3$ shows the existence of the compound trisodiumborate at molar ratios of sodium to boron over about 3:1. Janson suggested that trisodiumborate would not form in the sodium boron smelts because of the strongly basic character of the $B_2O_5$ ion but it has been shown experimentally that at least a portion of trisodium borate is formed by reacting berates in excess sodium carbonate at high temperatures. There is, however, evidence on a poor conversion efficiency of reactants to form trisodiumborate in sodium carbonate-borate smelts for example in the body of U.S. Pat. No. 2,146,093 "Method of producing caustic borate products". A high reaction temperature, at least 1050° C. is needed to obtain trisodiumborate from the reactants and as high as 50 molar percent of the carbonate reactant is still left unreacted in the smelt (FIG. 3 and appended text to FIG. 3 in U.S. Pat. No. 2,146,093). More recently it has been shown experimentally that the reaction of boric oxide in excess of sodium carbonate yields both trisodiumborate and sodium metaborate.

From experimental data in literature, reaction kinetics of the reaction of borates with sodium carbonate to form trisodiumborate appears to be slow, at least below the melting point of the sodium metaborate at 968° C. Recovery boiler smelt zones are normally operating in the temperature range of 900–1000° C. Any presence of carbon dioxide above the reaction mixture, would further depress decarbonisation reactions. A smelt comprising the reactants sodium carbonate and sodium metaborate, injected by the spent liquor in a recovery furnace operating a smelt zone at around 950° C. will thus contain a substantial portion of unreacted sodium metaborate in addition to higher borates such as disodium borate. Moreover, the endothermic nature of the autocausticizing reactions in the furnace smelts may, at least locally, lower the temperature in the char bed increasing the fraction of unreacted sodium metaborate and sodium carbonate in the smelt.

Sodium metaborate ($Na_2BO_2$) is rapidly formed it smelts by reacting borates with sodium is carbonate in molar proportions between sodium and boron above about 1:1 at temperatures above about 950° C. At sodium to boron molar ratios lower than about 1:1, compounds with higher boron content such as $2B_2O_3 \times Na_2O$ disodiumtetraborate or commonly, anhydrous borax, will be formed.

The dissolving of sodium borates with high boron content in aqueous liquids does not provide for enough alkalinity to be of interest in alkaline pulping applications. For example borax solutions have a pH ranging from about 9–10 at temperature ranges of interest. Moreover, the dead load of inorganic material will increase linearly with decreased sodium to boron ratio in the circulating liquors with proven negative impact on spent liquor viscosity and recovery boiler load.

From the above cited prior art, discussion and experimental evidence it is thus apparent that a substantial portion of sodium metaborate and sodium carbonate will be present in smelts resulting from combustion of boron containing pulping liquors with sodium to boron molar ratios higher than about 1:1. The content of sodium metaborate in the pulping liquor, obtained after dissolving the sodium and boron containing smelt, would in addition to metaborate already present in the smelt also comprise a portion of sodium metaborate from hydrolysis of any trisodiumborate or tetrasodium metaborate formed in the smelt.

As referred to above, pulping liquors based on sodium metaborate with or without the presence of sodium carbonate have hitherto not been considered appropriate for use in line pulping processes.

In the laboratories of the inventor of the present invention new discoveries have been made relating to sulphur chemicals free pulping and a new process named the NovaCell™ process is being tested in mill scale in central Europe. The new process is partly described in PCT/SE00/00288, published as WO 00/47812. Although WO 00/47812 describes a process with several advantages relative to the traditional Kraft process, the capital and operating costs for causticizing and lime reburning is quite considerable for certain applications and wood raw materials.

The major objective of the present invention is to provide an alkaline process for the manufacturing of pulp from lignocellulosic material wherein alkali metaborate is providing alkalinity and buffering capacity during delignification. At least a portion of the alkali used for delignification is recovered from the chemicals recovery cycle in the mill without prior reactions with lime for generation of strong alkali. Other objectives such as elimination of odorous compounds by replacing sulphide with quinone catalysts will be further described in the detailed description and appended claims.

SUMMARY OF THE INVENTION

The present invention concerns a new environmentally sound, capital and cost-effective process for the manufacturing of chemical and semi-chemical pulp from lignocellulosic material. The process uses alkaline pulping liquors comprising dissolved alkali metaborate and alkali carbonate as major alkaline components providing alkalinity and buffering capacity during delignification. The alkaline components of the pulping liquor are recovered from a chemicals recovery furnace and at least a portion of the alkali is recycled and used for delignification without any prior reactions with lime for generation of alkali hydroxide. A quinone based delignification catalyst may be added to be present during delignification. In a preferred embodiment of the invention the quinone pulping catalyst is added prior to alkaline delignification, said delignification conducted in the substantial absence of sulphide.

SHORT DESCRIPTION OF THE DRAWINGS

The invention will be described in closer detail in the following description, with reference to the attached drawings, in which.

DETAILED DESCRIPTION OF THE INVENTION

Figure 1:
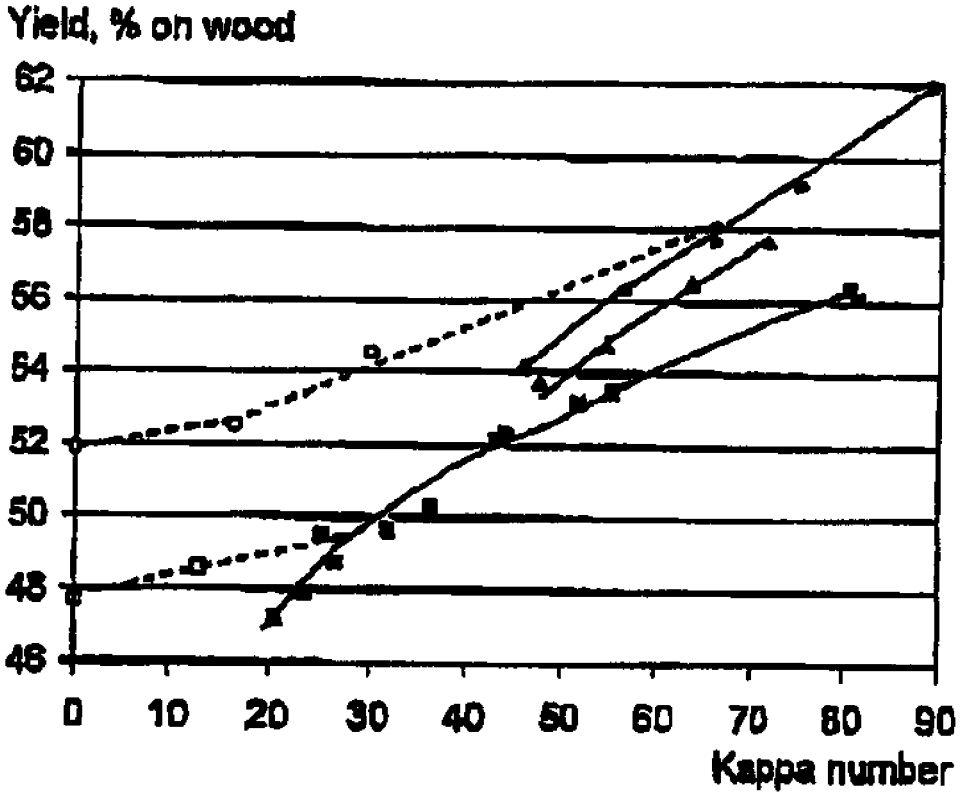
FIG. 1 is a diagram show pulp yield as a function of kappa number for softwood (*Picea abies*) for a process according to the present invention, Soda-AQ and Kraft process. Solid lines correspond to cooking and dotted lines to oxygen delignification and bleaching.

Laboratory studies performed by the present inventor have shown that a mild prehydrolysis pre-treatment (hydrothermolysis) of softwood material (*Picea abies*) in the presence of a delignification catalyst, primarily anthraquinone (AQ) or its derivates, improves the cooking results significantly compared to the traditional soda AQ cooking. The application of AQ in a slightly acidic environment prior to cooking has shown surprising effects on the delignification selectivity, which is quite contradictory to common experience and practise, wherein AQ is added in a strongly alkaline environment. Now it has been discovered that the appropriate application of quinone based catalysts combined with delignification using alkaline solutions comprising sodium metaborate ($NaBO_2$) and ($Na_2CO_3$) as major components can efficiently delignify lignocellulosic material and that the rate of delignification is considerably improved relative to prior art borate pulping schemes. These discoveries open up for a complete elimination of the causticising and lime reburning operation in alkaline pulp mills and enable a conversion from Kraft to a sulphur fee process in existing mills with a minimum of capital expenditure. New pulp mills can be erected without installation of causticizing, lime reburning and odorous gases treatment plants.

The fibreline of the softwood or hardwood mill practising the present invention thus comprises a wood size reduction step providing a stream of finely divided lignocellulosic material followed by a wood pre-treatment stage wherein the lignocellulosic material is subjected to hydrothermolysis by the action of steam or heat treatment in a hot aqueous solution. The hydrothermolysis is conducted in period of from about 2 to 200 min in a temperature range of 90–150 C. Excess liquor may be withdrawn from the pre-treatment stage, such liquor having a pH below 7 and comprising organic acids and dissolved metal ions such as Ca and Mn ions. AIL organic or inorganic delignification catalyst is added to or after the hydrothermolysis stage such catalyst being present in a subsequent delignification stage. The hydrothermolysis impregnation step is followed by alkaline delignification in an aqueous buffer alkali solution comprising alkali metaborate and alkali carbonate as major components.

The metaborate and carbonate is thus providing a buffering effect during delignification in the present invention. The mechanism is not fully clear but it is known that the conjugate base of monomeric boric acid in aqueous systems is the tetrahydroxyborate anion or metaborate anion $B(OH)_4$". The metaborate anion is the predominant specie at higher pH in alkali metaborate solutions while polyboric species are supposedly present at lower pH in accordance with;

$$4B(OH)_4^- = B_4O_5(OH_4^{2-} + 2OH^- + 5H_2O$$

and $$3B(OH)_4^- = B_3O_3(OH)_5^{2-} + OH^- + 3H_2O$$

Thus in metaborate anion containing buffer solutions, fresh hydroxyl ions may be formed and used for dissolving lignin.

The alkali metaborate containing liquor of the present invention is thus providing buffering capacity during delignification in a pH range between 11 and 13. Synergistic buffering effects may be obtained with the carbonate ions also present in the pulping liquor.

The aqueous buffer alkali may contain other compounds but as these components either are inert and undesirable or formed by dissolution of higher borates which, as discussed above, are recovered in rather low yields and only under ideal conditions at high temperature in a recovery boiler smelt, the combined concentration of alkali metaborate and sodium carbonate in the pulping liquor of the present invention is kept higher than the combined concentration of other components.

The concentration of metaborate or metaborate ions in the buffering solution relative to the combined sodium and potassium content of the solution should be kept within a certain range. An upper limit is set to avoid formation of excessive amounts of inert higher borates such as borax in the recovery smelt and a lower limit set to provide a meaningful concentration of metaborate or metaborate ions in the buffering solution. Thus the metaborate and metaborate ions should be present in an amount providing a sodium plus potassium to boron ((Na+K)/B) molar ratio in the alkaline buffer solution in the range from about 1:1 to about 10:1. Preferably the range is kept between 1,5:1 and 5:1 and yet more preferable in the range of 15:1 to 4:1.

The requirement of boron compounds for obtaining the desired concentration of metaborate or metaborate ions in the alkaline buffer can be provided, for example, by the addition of a boron compound such as boric acid or an alkali borate to the spent pulping liquor.

The delignification is allowed to proceed until a lignin content corresponding to kappa numbers ranging from about 20 to 120 for softwood pulp qualities and from about 15–100 for hardwood pulp qualities is obtained. For the manufacturing of bleached pulp qualities, cooking may be followed by extended oxygen delignification using metaborate/carbonate alkali as alkali source and final bleaching to the desired brightness in TCF or ECF sequences. The metaborate alkali could be used, with or without addition of strong alkali, to provide alkalinity in alkaline bleaching stages including peroxide bleaching stages.

Recovery of energy and chemicals is an essential feature of any modem pulping process. The spent pulping liquor from the alkaline pulping process of the present invention, the metaborate black liquor, is extracted from the digester and transferred to an evaporation plant. After concentration the black liquor is burned in a recovery boiler or fully or partially oxidised in a gas generator for recovery of energy and chemicals. The inorganic ash or smelt is recovered and mixed with an aqueous solution to form new raw cooking liquor. Non-process elements are removed and the fresh metaborate containing cooking liquor is recycled to the fibreline to complete the cycle.

The solid or liquid ash stream from a recovery boiler or gas generator comprises alkali metaborate and alkali carbonate, which substances, or corresponding ions after dissolution of the solid or liquid ash stream in an aqueous solution, are present in a combined concentration which is higher than the combined concentration of other dissolved compounds originating from dissolution of said solid or liquid ash stream in the aqueous solution.

In should be recognised that the alkali borate to a great extent is dissociated in ($Me^+$), $B(OH)_4^-$ and polyboric anions in the pulping liquor but for convenience, and as is common practise in the pulping industry, the pulping liquor components are expressed as ($NaBO_2$) (Sodium metaborate), (NaOH) or ($Na_2CO_3$) rather than as ions in solutions. ($Me^+$) is a sodium or potassium cat ion.

Strong alkali in the form of hydroxide ions may also be present in the pulping liquor, such hydroxide ions originating from any alkalisulphide, disodiumborate or tisodiumborate components formed in the furnace smelt, which components upon dissolution will form hydroxide ions.

Typical concentration ranges of the components in the pulping liquor of the present invention are as follows;

| | |
|---|---|
| $NaBO_2$ | 25–150 gram/liter (polyborates calculated as $NaBO_2$) |
| $Na_2CO_3$ | 25–100 gram/liter |
| NaOH | 0–50 gram/liter |
| $Na_2S$ | 0–40 gram/liter |
| $NaBO_2 + Na_2CO_3$ | 80–200 gram/liter and >NaOH + Na2S |
| Total alkali | 100–200 gram/liter |

The charge of total alkali on wood needed in order to obtain the desired degree of delignification will vary with wood species and product specifications, but is in the order of 100–300 kg chemicals on dry wood for chemical pulps and 40–150 kg for the preparation of semi chemical pulps.

Figure 2:
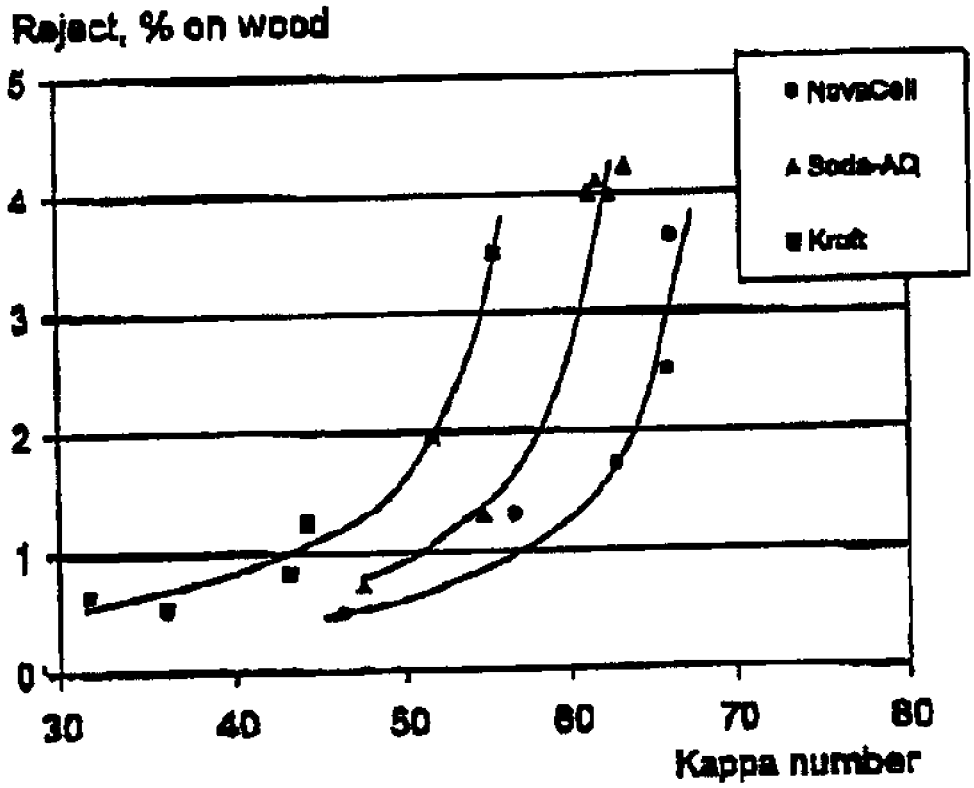
FIG. 2 is a diagram showing the reject yield as a function of kappa number for softwood (*Picea abies*) for a process according to the present invention, Soda-AQ and Kraft process.

Some initial laboratory experiments have been performed on softwood and, as shown in FIG. 1, the pulp yield obtained by the new process may be significantly higher at a given kappa number compared to conventional Kraft cooling. The yield gain at kappa number 60 is 3–4% on wood compared to the conventional Kraft process and 1% higher compared to the traditional soda AQ process. In addition for softwood pulping applications using the new process, the fibre defibrillation is moved towards higher kappa numbers (lignin contents), FIG. 2. When producing pulps of bleachable grades the cook can thus be terminated at high kappa numbers prior to oxygen delignification without inter-stage mechanical refining. This cooking schedule will support a higher overall pulp yield and furthermore, shorter cooking time in the digester is required. The preliminary laboratory results indicate that the fully bleached pulp can be obtained in 3–4% higher pulp yield compared to Kraft pulp. This corresponds to a wood saving in the order of 6–8% at a given production rate or an increased capacity of 6–8% at a given wood consumption.

The high fibre defibrillation point obtained in the new process enables the production of high yield pulps for sack and liner qualities without on-line refining. Energy savings in the order of 300 kWh/ton of pulp as well as pulp quality improvement (due to less mechanical damage) can be expected. As shown in FIG. 1, the yield gain at kappa number 80 is approximately 4% on wood compared to Kraft process. Another interpretation and/or route to exploit the yield gain may be that at a given pulp yield the lignin content in pulp can be reduced while the carbohydrate content is increased, translating to a greater flexibility in tailoring the fibre properties.

The present invention is illustrated further by the following example, performed during the priority year, where bleached pulp was prepared in accordance with the present invention and for comparison, a Kraft reference pulp was prepared from standard Kraft pulping liquor.

EXAMPLES

Preparation of Metaborate Pulp in Accordance with Invention

An aqueous solution of sodium carbonate 30 g/l, sodium metaborate 45.7 an and sodium hydroxide 50 g/l was used as borate cooled liquor it cooking experiments. The cooking liquor in an amount, as effective alkali (NaOH) of 10% based on the weight of the wood, and 0.2% AQ also based on wood, were added to 300 g of chips of eucalyptus (*Eucalyptus globulus*). The metaborate cooking was conducted at a temperature of 160° C. for 90 minutes. Liquor-to-wood ratio was 4:1. After cooking the chips, containing the cooking solution, were defibrated gentle in a laboratory disc refiner (Sprout Waldron) to fibre bundles at a refining slit of 0.3 mm and washed. The kappa no of 62 was obtained after metaborate cooking.

Further delignification was carried out in two consecutive oxygen stages. A fresh aqueous solution comprising sodium carbonate, sodium metaborate and sodium hydroxide was added to the defibrated fibrous material in an amount, as actual chemicals (NaOH), of total 2% based on the weight of the od pulp (1% in each O-stage). The partial pressure of oxygen was 1 MPa and temperature 140° C. in both O-stages. Reaction time in the first O-stage was 30 minutes and in the second O-stage 90 minutes. Pulp consistency in oxygen stages was 20%. Kappa number after oxygen delignification was 15.3.

Kraft Reference Pulp

For comparison, eucalyptus chips from the same batch were delignified by a Kraft process under the following conditions: effective alkali (NaOH) charge of 17% on wood, sulphidity of 40%, liquor-to-wood ratio of 4:1. Kraft cooking was conducted at a maximum cooking temperature of 160° C. for 64 minutes Kappa number after Kraft cooking was 17.5. The Kraft pulp was further delignified in one oxygen stage at 100° C. for 38 minutes and at an oxygen partial pressure of 0.7 MPa. Pulp consistency in oxygen stage was 12%. Kappa number after oxygen delignification was 13.1.

The metaborate and Kraft pulps obtained after descriptions above bleached in a sequence D(E+P)DED. Bleaching data for both pulps are given in table 1.

TABLE 1

Bleaching conditions in D(E + P)DED-sequence for metaborate and Kraft pulp respectively

| Bleaching stage | Charge to final brightness 89% ISO, kg/t: Metaborate pulp | Charge to final brightness 89% ISO, kg/t: Kraft pulp | Temp., ° C. | Time, min | Conc., % |
|---|---|---|---|---|---|
| D | 18.4 (act. Cl) | 15.7 (act. Cl) | 50 | 45 | 10 |
| E + P | 8.6 (NaOH)<br>3.0 ($H_2O_2$) | 7.5 (NaOH)<br>3.0 ($H_2O_2$) | 60 | 60 | 10 |
| D | 8.2 (act. Cl) | 4.4 (act. Cl) | 70 | 120 | 10 |
| E | 3.0 (NaOH) | 3.0 (NaOH) | 70 | 60 | 10 |
| D | 4.1 (act. Cl) | 2.2 (act. Cl) | 70 | 240 | 10 |

The comparative data obtained by the process of the invention and by the Kraft process are given in Table 2. The strength properties are given in Table 3.

TABLE 2

Pulp properties after cooking, oxygen delignification and ECF-bleaching for NovaCell-Borate and Kraft pulp

| | Cooking | | | | Oxygen delignification | | | | ECF-bleaching | | | |
|---|---|---|---|---|---|---|---|---|---|---|---|---|
| Process | Kappa | Visc., ml/g | Yield, % on wood | ISO-brightn., % | Kappa | Visc., ml/g | Yield, % on wood | ISO-brightn., % | ISO-brightn., % | Reversion, % | Visc., ml/g | Yield, % on wood |
| Metaborate | 61.6 | — | 67.5 | 23.2 | 15.3 | 1000 | 59.8 | 64.1 | 88.7 | 82.9 | 900 | 57.3 |
| Kraft | 17.5 | 1530 | 57.1 | 43.1 | 13.1 | 1420 | 56.8 | 55.3 | 89.0 | 84.8 | 1230 | 55.4 |

TABLE 3

Strength properties of fully bleached metaborate (ISO 88.7%) and Kraft pulp (ISO 89%) at zero and 1500 revolutions in PFI-mill

| Properties/Pulp | Metaborate | Kraft | Metaborate | Kraft |
|---|---|---|---|---|
| PFI-revolutions | 0 | | 1500 | |
| Density, $m^3$/kg | 621 | 584 | 699 | 682 |
| WRV, g/g | 1.53 | 1.53 | 1.81 | 1.65 |
| Tear index, $mNm^2$/g | 8.4 | 6.2 | 9.9 | 10.4 |
| Stretch at rapture, % | 2.6 | 1.8 | 3.3 | 2.8 |
| Tensile index, Nm/g | 60 | 48 | 87 | 81 |
| Tensile energy abs, index, mJ/g | 1109 | 583 | 1982 | 1561 |
| Tensile stiffness index, kNm/g | 7.5 | 7.2 | 8.7 | 8.8 |
| Burst index, $kPam^2$/g | 2.9 | 2.0 | 5.4 | 4.6 |
| Zerospan tensile index, wet, Nm/g | 157 | 174 | 161 | 179 |
| Light scattering value, $m^2$/kg | 32.4 | 35.8 | 26.3 | 28.3 |
| Opacity, % | 72.6 | 75.3 | 68.3 | 70.3 |

The strength properties were determined according to applicable SCAN-test methods. The SCAN-test methods are test methods standardized jointly for the pulp and paper industry in the Scandinavian countries, prepared published and distributed by the Nordic Standardization Programme, NSP. Documentation is available from STFI, Stockholm, Sweden.

As is apparent from the table 2 and 3, the quality of the pulp made by the process of the invention is obtained at a higher yield, approximately 2%-units on wood, and equal or better in strength properties such as tensile index and other tensile related strength properties (tensile energy absorption and tensile stiffness index), burst and tear index.

The pulping liquor used for preparation of metaborate hardwood pulp in accordance with the example above can be recovered without using a separate recausticizing plant. This a major economical advantage for the pulp mill operator.

It has been suggested tat in alkaline environment quinone based pulping catalysts such as AQ work in a redox-pair with anthrahydroquinone, AHQ. In this reaction, AQ stabilises the carbohydrates by oxidising their reducing end-groups to more alkali-stable aldonic acid groups while AQ itself is reduced to AHQ. The AHQ formed reacts with the lignin, which is fragmented, while AHQ is oxidised back to AQ. The efficiency of anthraquinone, added prior to and present in an alkaline delignification stage wherein metaborate and carbonate ions are major components, is quite surprising, and the mechanisms involved are not clear to us. Earlier work clearly indicated a negative influence of borate on the rate of delignification and it was proposed that the retardation of borate pulping was due to a substantial delay in the start of the bulk delignification stage. (Prihoda et al., supra, see page 459). Furthermore, an increase in ionic strength of the pulping liquor is claimed to retard the rate of delignification in conventional alkaline processes. A pre impregnation zone or hydrothermolyis stage wherein a quinone additive is added prior to an ate pulping stage, as in a preferred embodiment of the present invention, seems to negate the delay of the bulk impregnation stage in sulphide free borate pulping schemes.

Treatment of wood chips with steam or water of up to 200° C. has been practised commercially as a first stage in the manufacture of dissolving pulps, where the objective is to remove the hemicellulose while preserving the alpha-cellulose. Operation of a mild prehydrolysis stage (hydrothermolysis) at a temperature below 140° C., preserving a larger portion of the carbohydrates, followed by an alkaline delignification stage, enable the production of a chemical pulp in higher yield with preserved fibre strength properties. A requirement is that lignin self-condensation reactions are suppressed during hydrothermolysis. Our present hypothesis is that anthraquinone may have a dual function in the new process, as a lignin condensation prevention or lignin-carbohydrate bond breaker additive active during hydrothermolysis and as a delignification catalyst, protecting carbohydrates from excessive peeling and supporting delignification in the subsequent metaborate alkaline cooking stage. The latter function is not inhibited as a consequence of the presence of borate ions; on the contrary, due to the buffering capacity of metaborate and/or other effects the rate of delignification is increased, in spite of a higher ionic strength.

While the description herein largely relates to the use of sodium as alkali metal base, potassium and sodium/potassium mixtures may be the preferred alkali metal bases in mill scale applications. It can be noted that $K(BO_2)$ or potassium metaborate, have a stronger alkaline reaction in solution, buffering at higher pH than sodium metaborate and thus could be an even better base, particularly for pulping pine and other softwoods. Potassium metaborate would be formed directly in the smelt of a recovery furnace. Higher potassium borates, di and tri potassium monoborate, are only sparsely reported in literature but whether these compounds, which would yield a strongly alkaline reaction, would form in a recovery furnace is unclear.

The method of the present invention can be practised and introduced in existing Kraft or soda mills and cat be used for making chemical, high-yield and so chemical pulps from both hardwoods and softwood. While an important feature of the present invention is the potential to replace the sulphides used in the raft pulping process, some sulphur will always enter the liquor cycles and the sulphidity of the pulping liquor may therefore increase. A sulphide concentration level of below 5 grams/liter in the pulping liquor is desirable in a "non-sulphur" pulp mill and various forms of sulphur purge from the liquor or ash handling system should be explored.

Accordingly, various modifications and changes of the invention can be made and, to the extent that such variations incorporate the spirit of his invention, they are intended to be included within the scope of the appended claims.

What is claimed is:

1. An alkaline process for the production of a pulp from lignocellulosic material and the recovery of pulping chemicals used in said process comprising the steps of:

a) providing a feed stream of finely divided lignocellulosic material, b) contacting lignocellulosic material in a digester with an alkaline aqueous buffer solution comprising at least one of a sodium or potassium compound and a boron compound, during a period of time and at a temperature sufficient to obtain a stream of substantially delignified lignocellulosic material, c) further treating said substantially delignified lignocellulosic material to obtain a pulp product, d) extracting spent liquor comprising dissolved lignin components and spent chemical substances from step b), e) partly or fully oxidizing spent liquor originating from step d) in a recovery boiler or gas generator providing one gaseous stream comprising carbon dioxide and one solid or liquid ash stream comprising at least one of a sodium or potassium compound and a boron compound, wherein i) a boron compound in the alkaline buffer solution in step b) is a metaborate or tetrahydroxy metaborate ion, $B(OH)_4$, originating from the dissolution of alkali borates in an aqueous liquid, said metaborate and metaborate ion being present in an amount providing a sodium plus potassium to boron ((Na+K)/B) molar ratio in the alkaline buffer solution in the range from about 1:1 to about 10:1, ii) the solid or liquid ash stream comprising sodium or potassium compounds and boron compounds provided in step e) is dissolved in an aqueous solution to provide an alkaline buffer solution comprising metaborate and carbonate ions, whereof at least a portion is transferred to step b) or c) without prior subjection to treatment with lime or calcium compounds for the generation of hydroxide ions, iii) the solid or liquid ash stream in e) comprises alkali metaborate and alkali carbonate, which substances, or corresponding ions after dissolution of the solid or liquid ash stream in an aqueous solution, are present in a combined concentration which is higher than the combined concentration of other dissolved compounds originating from dissolution of said solid or liquid ash stream in the aqueous solution.

2. A process according to claim 1 wherein the finely divided lignocellulosic material provided in step a) is subjected to a pre-treatment before contact with the alkaline buffer solution in step b).

3. A process according to claim 2 wherein the pre-treatment includes a mild prehydrolysis step where the lignocellulosic material is submerged in a hot aqueous solution or heat treated by the action of steam or both.

4. A process according to claim 1 wherein a delignification catalyst is added to be present in step b) of claim 1.

5. A process according to claim 4 wherein a delignification catalyst is added to the lignocellulosic material and present during the mild prehydrolysis step.

6. A process according to claim 1, wherein the concentration of sulphides in an aqueous alkaline buffer solution is lower than about 5 grams/liter.

7. A process according to claim 1, wherein further treating said substantially delignified lignocellulosic material to obtain a pulp product in c) comprises at least one of an alkaline oxygen delignification or an alkaline bleaching stage.

8. A process according to claim 7, wherein at least a major portion of alkaline buffer solution used in an oxygen delignification or bleaching stage is recycled from a chemicals recovery system without prior subjection to treatment with lime or calcium compounds for the generation of hydroxide.

9. A process according to claim 1, wherein at least a major portion of the alkaline buffer solution used in step b) is recycled from a chemicals recovery system without prior subjection to treatment with lime or calcium compounds for the generation of hydroxide.

10. Process according to claim 1, wherein a chemicals recovery system for recovery and preparation of alkaline buffer solution used in step b) does not include a lime kiln or causticizing plant for regeneration of pulping chemicals.

11. Process according to claim 4, wherein said delignification catalyst is selected from aromatic organic compounds, including anthraquinone or a derivative of anthraquinone and added in a quantity ranging from 0.05% to 0.5% on dry lignocellulosic material.

12. Process according to claim 4 wherein said delignification catalyst is a sulphide.

13. Process according to claim 1 wherein a boron compound in the alkaline buffer solution in step b) is present in an amount providing a sodium plus potassium to boron ((Na+K)/B) molar ratio in the alkaline buffer solution in the range of from about 1.5 to about 5.

14. Process according to claim 1 wherein a boron compound in the alkaline buffer solution in step b) is present in an amount providing a sodium plus potassium to boron ((Na+K/B) molar ratio in the alkaline buffer solution in the range of from about 1.5 to 4.

* * * * *